US006651474B2

(12) United States Patent
Heimann

(10) Patent No.: US 6,651,474 B2
(45) Date of Patent: Nov. 25, 2003

(54) DEVICE FOR THE FIXED-ROLLING OF CRANKSHAFTS

(75) Inventor: Alfred Heimann, Aachen (DE)

(73) Assignee: Hegenscheidt-MFD GmbH & Co. KG (DE)

( * ) Notice: Subject to any disclaimer, the term of this patent is extended or adjusted under 35 U.S.C. 154(b) by 17 days.

(21) Appl. No.: 10/003,708

(22) Filed: Oct. 24, 2001

(65) Prior Publication Data

US 2002/0108417 A1 Aug. 15, 2002

(30) Foreign Application Priority Data

Oct. 25, 2000 (DE) ..... 100 52 753

(51) Int. Cl.[7] ..... B21D 15/00
(52) U.S. Cl. ..... 72/110; 72/68; 72/94
(58) Field of Search ..... 72/68, 94, 107, 72/110, 301, 302, 311, 377, 378

(56) References Cited

U.S. PATENT DOCUMENTS 3,583,191 A * 6/1971 Colonius et al. ..... 72/110
4,682,489 A * 7/1987 Bauerle et al. ..... 72/460
4,726,212 A * 2/1988 Deroche et al. ..... 72/302
4,860,566 A 8/1989 Augustin
5,333,480 A * 8/1994 Berstein ..... 72/110
5,666,841 A * 9/1997 Seeger et al. ..... 72/110

FOREIGN PATENT DOCUMENTS

JP 62-296911 * 12/1987 ..... 72/378
JP 63-127871 5/1988

OTHER PUBLICATIONS

European Search Report.
Database WPI, Section PQ, Week 199524 Derwent Publications LTd., London, GB; AN 1995–183901 XP002188258 & RU 2 021 098C C (Teko Ltd Prodn Commerical Enterp), 15. Oktober 1994 (2994–10–15).
Database WPI, Section PQ, Week 199814 Derwent Publications Ltd., London GB; AN 1998–157766 XP002188257 & RU 2 086 393 C (Vozhdaenko V V), Aug. 10, 1997.

* cited by examiner

*Primary Examiner*—Ed Tolan
(74) *Attorney, Agent, or Firm*—Carlson, Gaskey & Olds

(57) ABSTRACT

The invention relates to a device for fixed-rolling radii or recesses on main (1, 2, 3, 4, 5) or connecting rod bearings (1', 2', 3', 4') of crankshafts (6) by means of fixed rollers and supporting rollers on the respective main (1, 2, 3, 4, 5) or connecting rod bearings (1', 2', 3', 4') to support the rolling force exerted on the crankshaft (6) by the fixed rollers. A device is provided for applying an additional external load (12) in the direction of the load on the crankshaft (6) that arises during operation while fixed-rolling the radii or recesses.

14 Claims, 4 Drawing Sheets

DEVICE FOR THE FIXED-ROLLING OF CRANKSHAFTS

BACKGROUND OF THE INVENTION

The invention relates to a device for fixed-rolling radii or recesses on main and connecting rod bearings of crankshafts by means of fixed rollers and supporting rollers on the respective main or connecting rod bearings to support the rolling force exerted on the crankshaft by the fixed rollers.

Fixed-rolling crankshafts using an additional external force applied in the direction of the load arising during operation is known in the art. For example, when fixed-rolling crankshafts consisting of high-strength materials, the rolling forces can be so great that the crankshafts can no longer be fixed-rolled with the normal tools without the fixed-rollers failing after a short time. The load of a tensile stress during fixed-rolling would allow the external load to reduce the rolling force to generate a similar distribution of axial internal stresses as during fixed-rolling without an external load. In crankshafts, this external load during fixed-rolling corresponds to an elastic bending of the crankshaft bearers (compare Achmus, Christian: "Measurement and Calculation of the Edge Layer State of Complex Components after Fixed Rolling", authorized dissertation, Braunschweig Technical University, 1998, Papierflieger publishing house, Clausthal-Zellerfeld, 1999, pp. 110 and 111).

The results of the aforementioned publication give rise to the object of this invention, which is to further develop known devices for fixed-rolling radii or recesses on main or connecting rod bearings of crankshafts in such a way as to impart a higher service life to conventional fixed-rolling tools, or fixed-roll crankshafts consisting of a high-strength material using conventional fixed-rolling tools with the usual service life. In this case, the further developed devices must be simple in design, safe to use and inexpensive.

SUMMARY OF THE INVENTION

The object is achieved by a device for applying an additional external stress in the direction of the load on the crankshaft that arises during operation while fixed-rolling the radii or recesses. In a preferred embodiment, the device consists of at least one clamping chuck for the crankshaft, which can exert a tensile force on the crankshaft in the longitudinal direction of the crankshaft.

However, the object of the invention can also be solved by applying a bending moment on the crankshaft. Such an arrangement can then consist of a clamping chuck, a tailstock or a collar plate, between which the crankshaft is clamped. The clamping chuck, tailstock or collar plate are designed in such a way that they can generate a bending stress in the crankshaft while the crankshaft rotates during the fixed-rolling process. A bending stress can be generated, for example, by setting the aforementioned elements at an angle or laterally shifting in a radial direction of the crankshaft.

One particularly simple design for the device is obtained by drawing upon the supporting rollers used for supporting the fixed rollers to apply an additional bending force. In addition, the bearers of the crankshaft can also be expanded with the help of additional expanding rollers.

BRIEF DESCRIPTION OF THE DRAWINGS

In the following, the invention will be described in greater detail based on several embodiments. Shown in highly simplified, diagrammatic form on.

DETAILED DESCRIPTION OF A PREFERRED EMBODIMENT

Figure 1:
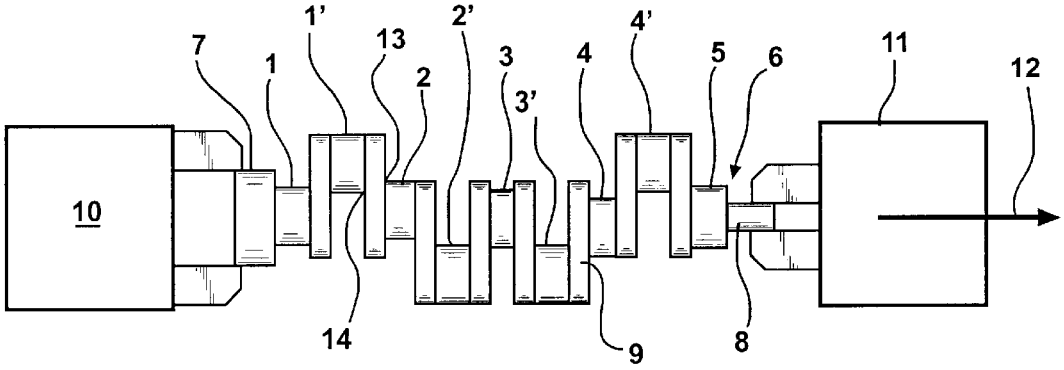
FIG. 1 is a device for applying a tensile force on the crankshaft.

The embodiments below focus on a crankshaft 6, e.g., of the kind used in a 4-cylinder combustion engine for motor vehicles. The crankshaft 6 begins at a flange 7 and ends at a pivot 8. Between the flange 7 and pivot 8 lie the main and connecting rod bearings of the crankshaft 6, between which the crankshaft webs 9 are located. Shown from left to right on FIG. 1 are first the main bearings marked 1, 2, 3, 4 and 5, and connecting rod bearings marked 1', 2', 3' and 4'. The embodiment on FIG. 1 provides for two clamping chucks 10 and 11, which are able to exert a tensile force 12 in an axial direction on the crankshaft 6.

As force 12 exerts a tensile stress in an axial direction, the crankshaft 6 is expanded during fixed-rolling by the clamping chucks 10 and 11. The force 12 generates a bending moment between the main bearings 1 to 5, the connecting rod bearings 1' to 4' and the respectively adjacent crankshaft webs 9 in transitional areas 13 and 14, where the fixed rolling of radii or recesses takes place. As a result of the tensile stresses existing at the transitional areas 13 and 14 to be fixed-rolled during exposure to the axial force 12 in the crankshaft 6, smaller fixed-roller forces are sufficient for the plastic deformation of the material of the crankshaft 6, or identically high fixed-roller forces yield a greater plastic deformation of the material of the crankshaft 6. In this case, compressive stresses come about on the surface of the transitional areas 13 and 14.

During the exertion of an axial force 12 of for instance 10,000 Newtons on a predetermined crankshaft 6, a preliminary stress of ¼ the stress at failure would be generated in the crankshaft 6. This makes it possible to reduce the magnitude of fixed-roller forces.

Figure 2:
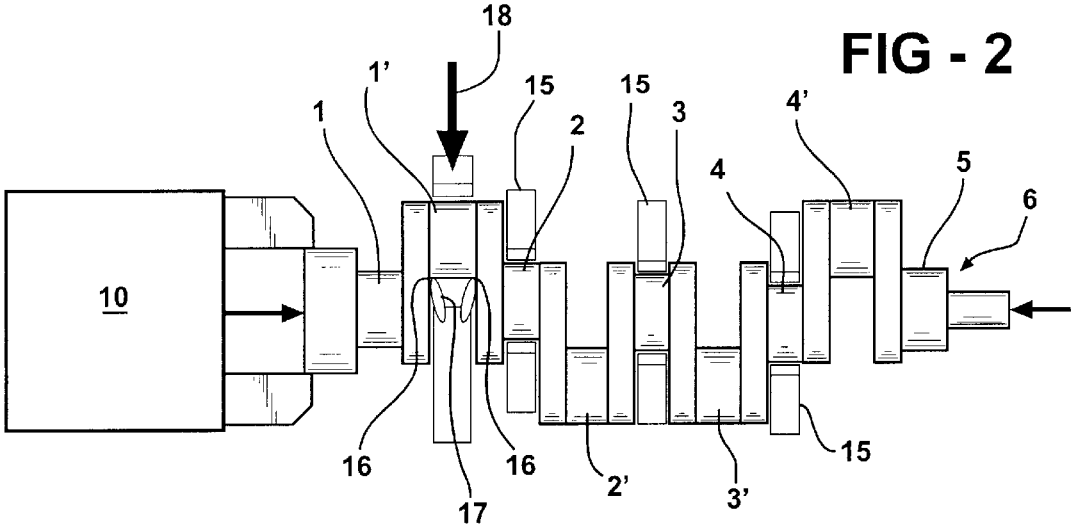
FIG. 2 and FIG. 3 is a device for applying an additional load on the crankshaft, FIG. 4
Figure 3:
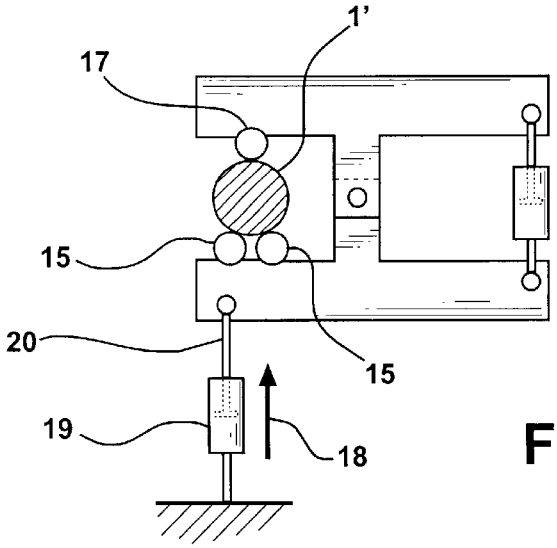

According to the embodiments on FIG. 2 and 3, an additional load is placed on the crankshaft 6 via supporting rollers 15. The additional load corresponds to the operating load of the crankshaft 6 in the engine (not shown). On FIG. 2, the crankshaft 6 is in turn clamped into a clamping chuck 10. Fixed-rollers 17 initiate fixed rolling in the transitional areas 16. Fixed rollers 17 are supported by supporting rollers 15 on the opposing side of the main bearings 1, 2, 3, 4 and 5 and connecting rod bearings 1', 2', 3' and 4'. In this example, the supporting rollers 15 are additionally exposed to another force 18.

As evident from FIG. 3, the additional force 18 is applied with a cylinder 19 that can be pressurized. The force of the cylinder 19 acts via the piston rod 20 directly on the supporting rollers 15, which support the rolling force from the fixed rollers 17, while the latter fixed-roll the transitions 16 at the connecting rod bearing 1'.

Figure 4:
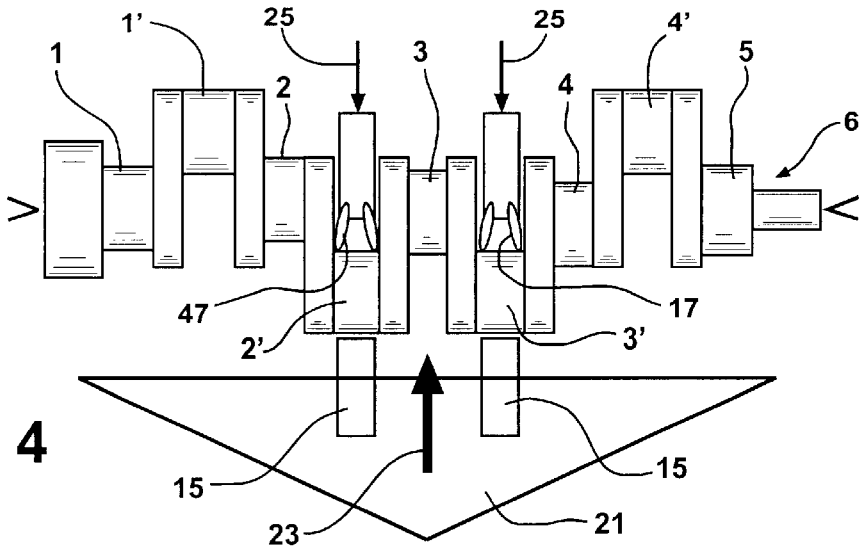
Figure 5:
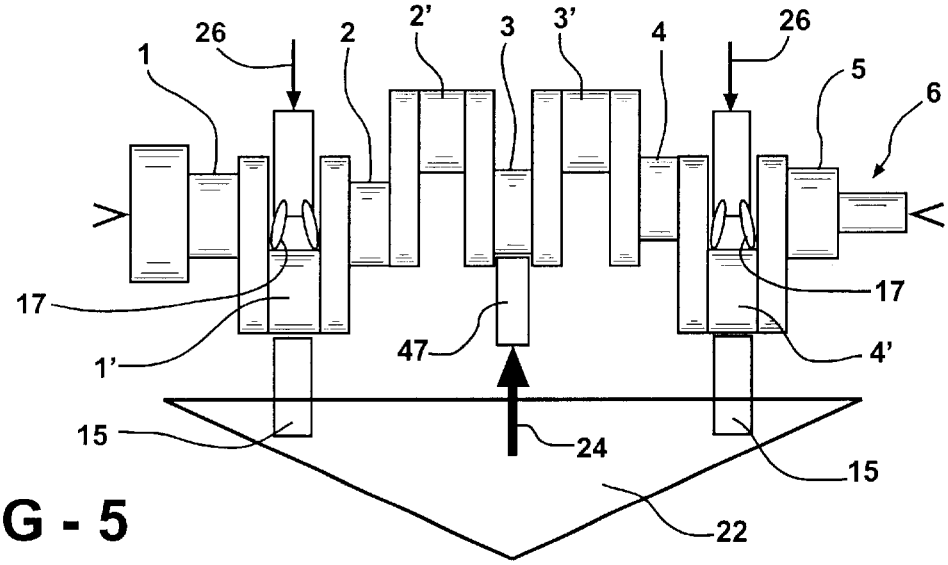
FIG. 5 is a device for applying a bending moment.

FIG. 4 and 5 show the bending moments 21 and 22 that act on the crankshaft 6 in a radial direction during exposure to the lateral forces 23 and 24. In the case shown on FIG. 4, the main bearing 3 is exposed to the lateral force 23 via the supporting rollers 15, and fixed-rolled on the connecting arm rollers 2' and 3'.

The fixed rolling forces are denoted by the arrows 25; the direction of arrow 25 shows the effect of the fixed rollers 17. In the case of FIG. 5, the main bearing 3 is exposed to the lateral force 24 via supporting rollers 47, and the crankshaft 6 is fixed-rolled on the connecting rod bearings 1' and 4'. The fixed rolling forces at play there, which are absorbed via supporting rollers 15, are denoted with 26. The additional force 24 is altered by a rotation of the crankshaft 6 in such a way that the bending moment 22 of the point just fixed-rolled has the desired level and sign.

Figure 6:
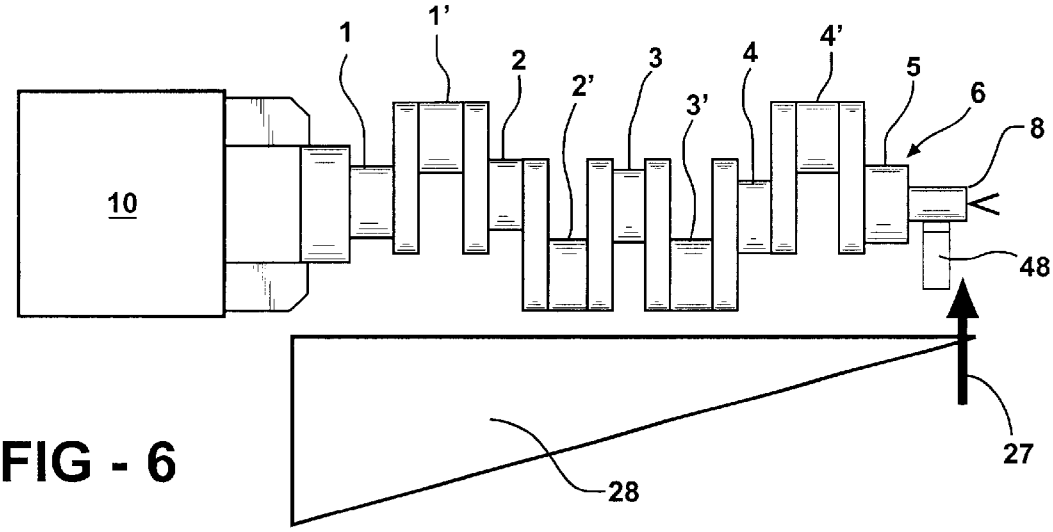
FIG. 6 is another device for applying a bending moment, FIG. 7, FIG. 8

According to FIG. 6, a lateral force 27 is exerted on the pivot 8 of the crankshaft 6 via supporting rollers 48. In this case, a bending moment 28 comes about inside the crankshaft 6 over the length of the crankshaft 6, and is absorbed by the clamping chuck 10. The bending moments 28 in the crankshaft 6 can also be generated by a further removed fixed roller device (not shown) or via the tailstock (not shown) or collar plate (not shown). In turn, all bearings 1 to 5 and 1' to 4' for which the bending moment 28 has the desired magnitude in terms of amount and sign can be fixed-rolled.

Figure 7:
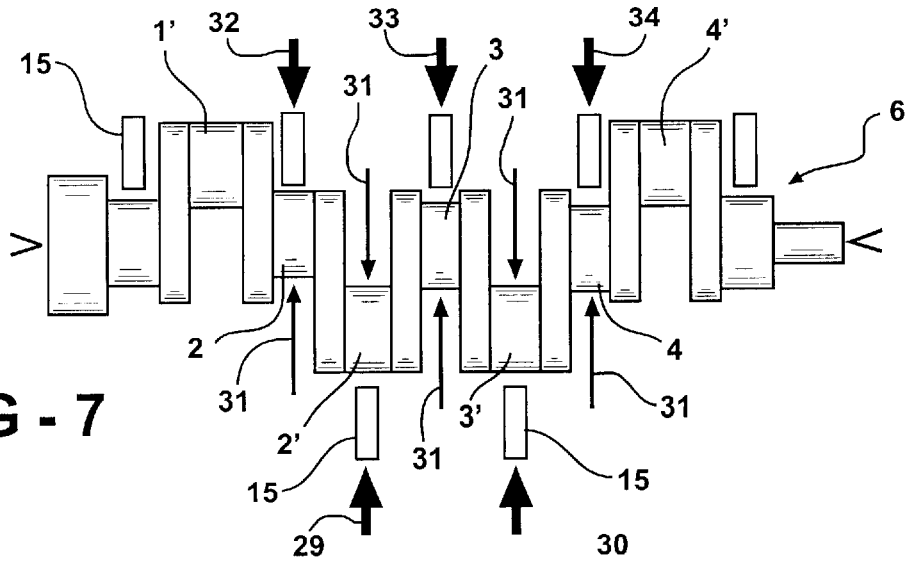

In the embodiment according to FIG. 7, the middle connecting rod bearings 2' and 3' are to be fixed-rolled under an additional load. The additional load is applied by the two additional forces 29 and 30, which act on the connecting rod bearings 2' and 3' of the crankshaft 6 via their respective supporting rollers 15. The fixed rolling forces 31 act on the main bearing 2, the connecting rod bearing 2', the main bearing 3, the connecting rod bearing 3' and the main bearing 4. The additional forces 29 and 30 generate the additional bending moment, i.e., correspond to the piston forces of an engine in the upper dead center. The three supporting roller forces 32, 33 and 34 act on the main bearings 2, 3 and 4, and hence correspond to the mounting of the crankshaft 6 in an engine. The supporting roller forces 32, 33 and 34 balance out the additional forces 29 and 30. Additional forces 32, 33 and 34 are also each conveyed to the crankshaft 6 via supporting rollers 15.

The area of the crankshaft 6 at risk for breakage can now be fixed-rolled under the additional load of the additional forces 29 and 30. The same holds true for the middle main bearing 3 and two main bearings 2 and 4 over a rotational angle of 180° of the crankshaft 6.

Figure 8:
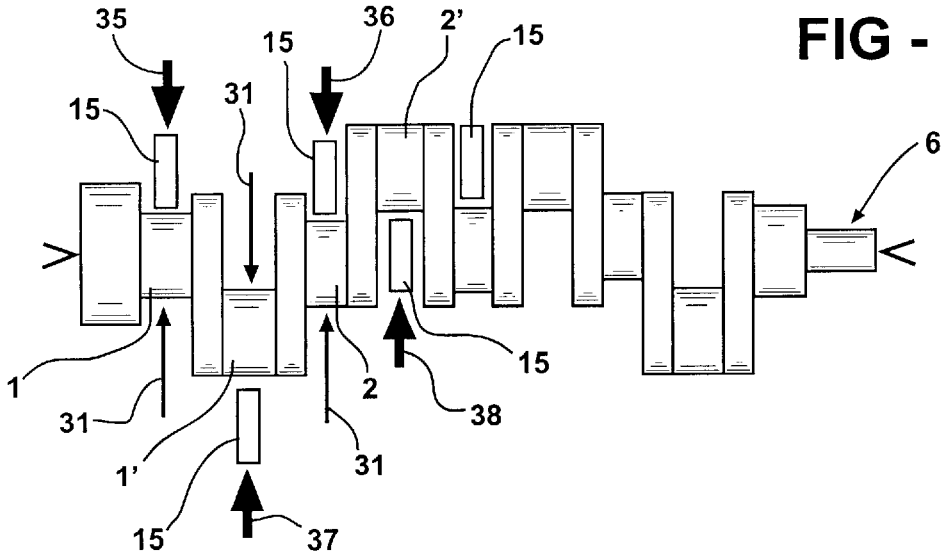
Figure 9:
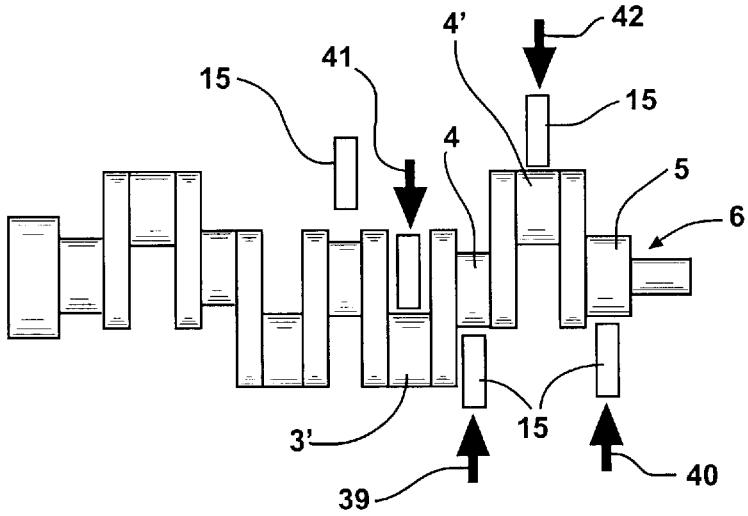
FIG. 9 is a device for applying additional forces on the crankshaft, FIG. 10

The connecting rod bearings 1' and 4' cannot be rolled in this configuration, since the fixed rolling forces 31 acting on the main bearings 2, 3 and 4 are taking effect in the wrong direction. As a remedy, the crankshaft 6 is shifted, and then rotated 180°. FIG. 8 analogously shows the fixed rolling of the two main bearings 1 and 2 and the connecting rod bearing 1'. Additional forces 35 and 36 act on the main bearings 1 and 2, while additional forces 37 and 38 act on the connecting rod bearings 1' and 2'. FIG. 8 also denotes the arrangement of supporting rollers 15.

While fixed-rolling the front main bearings 4 and 5 and connecting rod bearings 3' and 4', the additional forces 39 and 40 act on the main bearings 4 and 5, and the additional forces 41 and 42 act on the connecting rod bearings 3' and 4', wherein the crankshaft 6 is again rotated by 180°.

Figure 10:
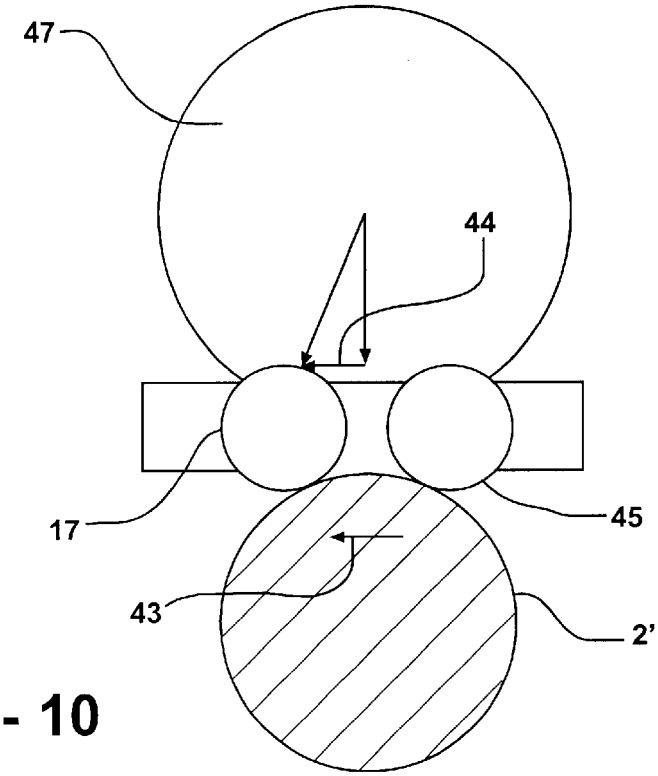
Figure 11:
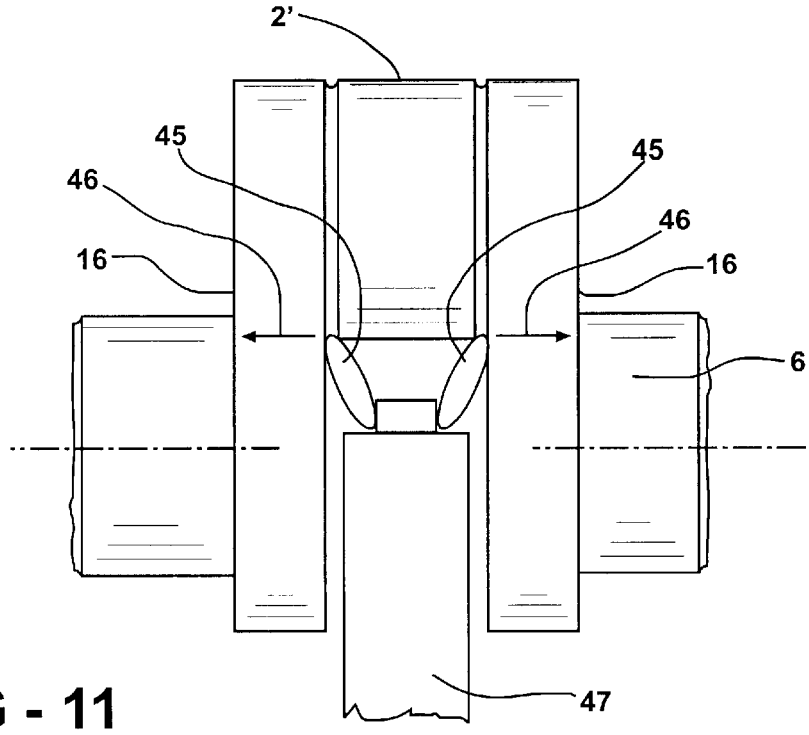
FIG. 11 is a device for expanding the bearers of a crankshaft.

Another embodiment of the invention will be described based on FIG. 10 and 11. A middle connecting rod bearing 2' of a crankshaft 6 (FIG. 11) is machined by the fixed rollers 17 of a fixed roller tool (not shown). The connecting rod bearing 2' rotates in the direction of arrow 43. The fixed roller 17 is offset by amount 44 in the rotational direction 43 relative to the line formed from the middles of the guide roller 47 and the connecting rod bearing 2'. A pair of expansion rollers 45 offset by about the same amount 44 in the opposite direction is provided, as clearly visible on FIG. 11. The expansion rollers 45 act in the direction of the arrows 46 on the bearers 16 of the crankshaft 6, and expand the bearers 16 in the direction of the arrows 46.

For example, at a fixed rolling force applied to the connecting rod bearing 2' via the fixed rollers 17 measuring for instance 4 t, the expansion rollers 45 generate an axially expanding force 46 in a magnitude of 6.2 kN. In this case, tensile residual stresses are generated in both the connecting rod bearing 2' and in the crankshaft webs 16.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A device for fixed-rolling radii or recesses on of a crankshaft by fixed rollers and supporting rollers on the respective bearings to support a rolling force exerted on the crankshaft by the fixed rollers, including an arrangement for applying an additional external load on the crankshaft during the fixed-rolling of the radii or recesses.

2. The device according to claim 1, wherein the arrangement consists of at least one clamping chuck for the crankshaft, which exerts a tensile force on the crankshaft in the longitudinal direction of the crankshaft.

3. The device according to claim 1, wherein the arrangement exerts a bending moment on the crankshaft.

4. The device according to claim 3, wherein the arrangement consists of a clamping chuck, a tailstock or collar plate, between which the crankshaft is tensioned.

5. The device according to claim 3, wherein the arrangement is formed by the supporting rollers, via which an additional bending stress is applied to the crankshaft.

6. The device according to claim 3, wherein the arrangement consists of a pair of expansion rollers.

7. The device according to claim 3, wherein said bending moment is created in a transitional area defined by an inner section of a bearing and a web.

8. A method of fixed-rolling crankshaft bearings comprising the steps of:

a) generating a tensile force along a crank shaft axis;

b) generating a bending moment with a force transversed to the crankshaft axis; and c) generating a fixed-rolling force in a transitional area defined by an inner section of a bearing and a web.

9. The method according to claim 8 wherein step a) includes generating a tensile stress in an axial direction defined by the crankshaft axis in the transitional area.

10. The method according to claim 8 wherein step b) includes applying a load on a crankshaft bearing different than the bearing in the transitional area.

11. The method according to claim 1 wherein the load is generated by a support roller actuator.

12. The method according to claim 10 wherein the load corresponds to an engine operating load on the bearing.

13. The method according to claim 8 wherein step c) includes a compressive stress in the transitional area.

14. The method according to claim 8, wherein step c) includes manipulating a fixed-rolling actuator to close scissor arms supporting a fixed rolling tool and a support rolling tool about the crankshaft bearing.

* * * * *

UNITED STATES PATENT AND TRADEMARK OFFICE

CERTIFICATE OF CORRECTION

PATENT NO. : 6,651,474 B2
DATED : November 25, 2003
INVENTOR(S) : Heimann

It is certified that error appears in the above-identified patent and that said Letters Patent is hereby corrected as shown below:

Column 4,
Line 28, please change “on of a” to -- on bearing of a --
Line 64, please change “claim 1 wherein” to -- claim 10 wherein --

Signed and Sealed this

Ninth Day of March, 2004

JON W. DUDAS
*Acting Director of the United States Patent and Trademark Office*